US008371772B2

(12) United States Patent
Chang

(10) Patent No.: US 8,371,772 B2
(45) Date of Patent: Feb. 12, 2013

(54) RETAINING WALL STRUCTURE

(76) Inventor: Yushun Chang, Guangdong (CN)

( * ) Notice: Subject to any disclaimer, the term of this patent is extended or adjusted under 35 U.S.C. 154(b) by 0 days.

(21) Appl. No.: 12/306,255

(22) PCT Filed: Nov. 28, 2007

(86) PCT No.: PCT/CN2007/003359
§ 371 (c)(1),
(2), (4) Date: Apr. 8, 2009

(87) PCT Pub. No.: WO2008/151483
PCT Pub. Date: Dec. 18, 2008

(65) Prior Publication Data

US 2009/0304458 A1 Dec. 10, 2009

(30) Foreign Application Priority Data

Jun. 14, 2007 (CN) ..... 2007 2 0052730 U

(51) Int. Cl.
*E02D 29/02* (2006.01)

(52) U.S. Cl. ..... 405/284; 405/18

(58) Field of Classification Search ..... 405/284, 405/286, 287, 107, 114, 115, 116, 117, 15, 405/16, 17, 18
See application file for complete search history.

(56) References Cited

U.S. PATENT DOCUMENTS

| | | | | |
|---|---|---|---|---|
| 4,486,115 | A * | 12/1984 | Rionda et al. | 403/283 |
| 4,650,368 | A * | 3/1987 | Bayer | 405/107 |
| 5,934,027 | A * | 8/1999 | Khalili | 405/84 |
| 7,083,364 | B2 * | 8/2006 | Kim | 405/284 |
| 7,314,336 | B2 * | 1/2008 | Moss | 405/262 |
| 7,452,164 | B2 * | 11/2008 | Kim | 405/284 |
| 7,677,841 | B2 * | 3/2010 | Shin et al. | 405/284 |
| 2006/0257212 | A1 * | 11/2006 | Kim | 405/284 |
| 2007/0041793 | A1 * | 2/2007 | Moss | 405/284 |

FOREIGN PATENT DOCUMENTS

| | | | |
|---|---|---|---|
| CN | 1563609 | * | 1/2005 |
| CN | 2853904 | * | 1/2007 |
| CN | 2866608 | * | 2/2007 |

* cited by examiner

*Primary Examiner* — Frederick L Lagman
(74) *Attorney, Agent, or Firm* — Wood, Phillips, Katz, Clark & Mortimer

(57) ABSTRACT

A retaining wall structure includes a number of bag units piled to form a wall and interconnecting units disposed between vertically adjacent bag units. The interconnecting units each has a plate and protrusions protruding from upper and lower surfaces of the plate. A reinforcing layer is provided between the plate of a relative interconnecting unit and a relative bag unit. The reinforcing layer is selected from cement or adhesive (such as glue). The present invention uses the reinforcing layer between the plate of the interconnecting unit and the bag unit to enhance the entire stability of the retaining wall adapted for operation in different circumstances.

5 Claims, 5 Drawing Sheets

RETAINING WALL STRUCTURE

BACKGROUND OF THE INVENTION

1. Field of the Invention

The present invention relates to a retaining wall structure, and more particularly to a retaining wall structure having an interconnecting unit, further, to a retaining wall structure having an interconnecting unit and a reinforcing layer.

2. Description of the Prior Art

Retaining walls are used to support embankments or slopes, preventing soil from being washed away and ensuring the stability of the embankments or slopes.

So far, there are many types of retaining walls. A traditional way is to lay reinforcing bars on the construction and then pour into concrete. This retaining wall needs huge works and is difficult to build. To solidify the concrete takes much time which causes a long period of construction. In addition, the retaining wall made of concrete is covered limited soil, which is easy to be washed away. The efficiency of vegetation is poor, which causes the difficulty in retaining embankments or slopes.

Nowadays, an improved retaining wall is to overcome the shortcomings of the traditional retaining wall, which is formed with a number of bags piled up. The bags are filled with sand/soil. In order to enhance the horizontal and vertical connection of the bags, an interconnecting member is provided between adjacent bags for connecting and stabilizing the bags. Chinese Patent No. ZL 200620054736.8 disclosed a bag and an interconnecting member. Chinese Patent No. ZL 200420066760.4 and Taiwanese Patent No. M273596 owned by the applicant disclosed a retaining wall structure constituted by a plurality of layers of sand/soil bags. However, the applicant found that the retaining wall structure using a simply interconnecting member to connect the bags is unable to bear adverse weather conditions, such as strong wind, heavy rain, and dust storm. The wall is easy to be damaged. This shortcoming needs to be improved.

Accordingly, the inventor of the present invention has devoted himself based on his many years of practical experiences to the development of an improved retaining structure adapted for different circumstances.

SUMMARY OF THE INVENTION

The present invention is to overcome the shortcomings of the prior art, and the primary objective of the present invention is to provide a retaining wall structure having an interconnecting unit and a reinforcing layer to enhance the entire stability of the retaining wall structure so as to adapt for operation in different circumstances.

According to the present invention, there is provided a retaining wall structure, comprising a number of bag units piled to form a wall and interconnecting units disposed between vertically adjacent bag units, the interconnecting units each comprising a plate and protrusions protruding from upper and lower surfaces of the plate, and characterized by that a reinforcing layer is provided between the plate of a relative interconnecting unit and a relative bag unit.

Preferably, the plate of each of the interconnecting units is formed with a number of through holes for permeation of the reinforcing layer.

Preferably, the reinforcing layer is a cement layer or an adhesive layer.

Preferably, a reinforcing net is provided on every other layer or multiple layers of the bag units, the reinforcing net being tightly attached between the plate of the interconnecting unit and the reinforcing layer, the protrusions on the plate penetrating through net holes of the reinforcing net.

Preferably, the bag unit is a containing bag.

Preferably, the containing bag is filled with stuffing and plant sees.

Compared to the prior art, the advantage of the present invention is that the present invention uses the reinforcing layer between the plate of the interconnecting unit and the bag unit to enhance the entire stability of the retaining wall adapted for operation in different circumstances.

DETAILED DESCRIPTION OF THE PREFERRED EMBODIMENTS

Embodiments of the present invention will now be described, by way of example only, with reference to the accompanying drawings.

Figure 1:
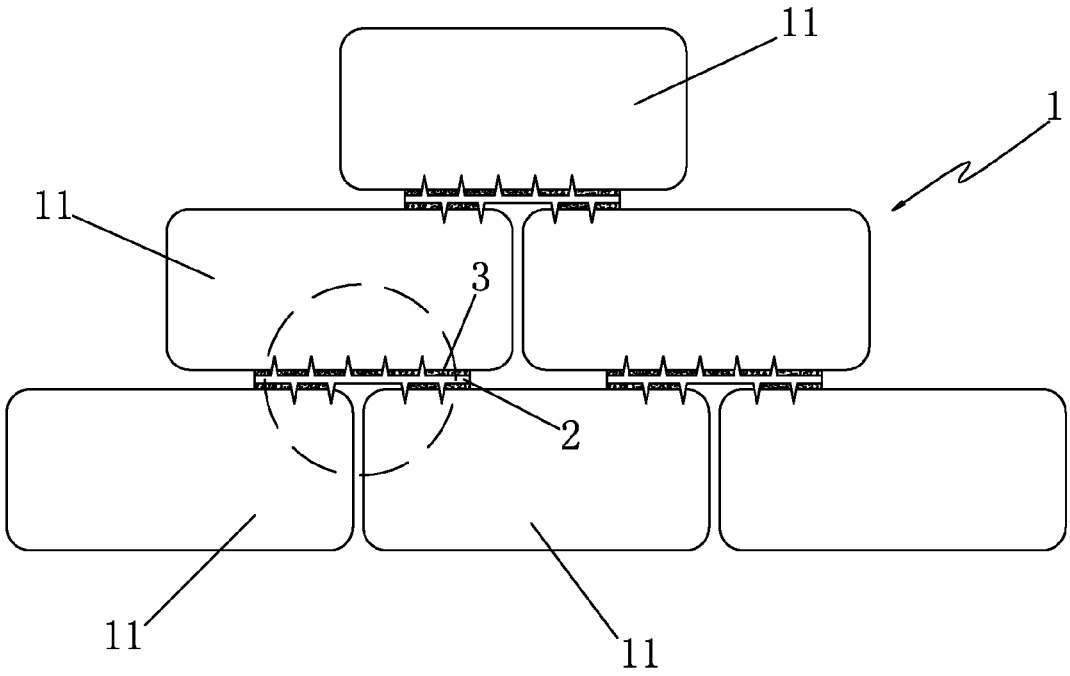
FIG. 1 is a schematic view according to a first preferred embodiment of the present invention.
Figure 2:
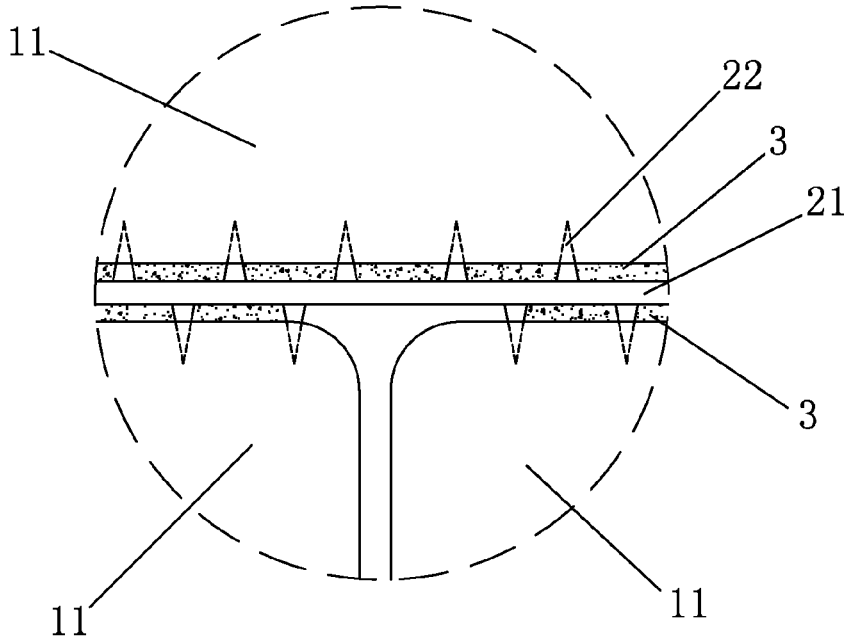
FIG. 2 is a partially enlarged view of FIG. 1.
Figure 3:
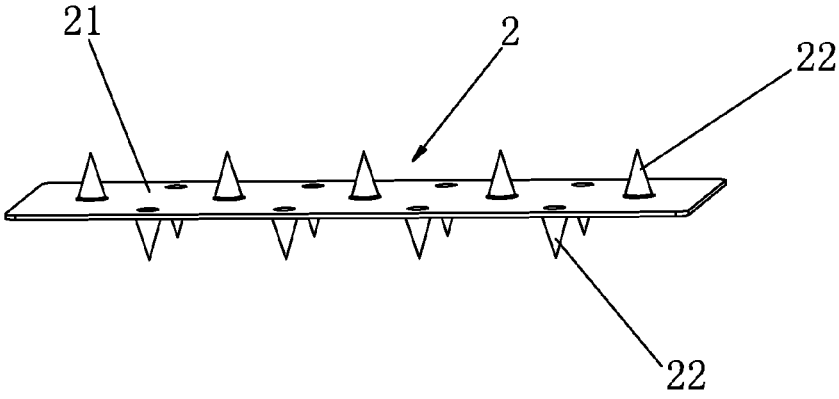
FIG. 3 is a perspective view of an interconnecting unit according to the first preferred embodiment of the present invention.

FIGS. 1 through 3 show a first preferred embodiment of the present invention. A retaining wall structure comprises a number of bag units 11, interconnecting units 2 located between vertically adjacent bag units 11, and reinforcing layers 3.

Each bag unit 11 is made of a material which is ventilative and permits water to flow in and though the bag, while retains stuffing within the bag, such as non-woven fabric sewed by hand or by machinery so that water is easy to permeate into the bag unit 11. The bag units 11 are laid horizontally and vertically to form a wall 1. The bag unit 1 is substantially a containing bag. When it is not used for green purpose, the bag may be filled with sand/earth. When it is used as a planting bag for green purpose, the bag may be filled with stuffing. The stuffing is a mixture of plant growing material and absorbent material. The plant growing material is soil or organic soil. The absorbent material is absorbent resin. Plant seeds may be mixed in the stuffing. The plant growing material and absorbent material provide essential nutrients and moisture to the plant seeds, achieving a green effect.

The interconnecting units 2 are located between vertically adjacent bag units 11 for connection of the bag units 11, and each comprises a plate 21 and upper and lower protrusions 22 extending from upper and lower surfaces of the plate 21. In this embodiment, the plate 2 doesn't have a through hole, as shown in FIG. 3.

Each reinforcing layer 3 is disposed between the plate 21 of the interconnecting unit 2 and the bag unit 11. The reinforcing layer 3 may be selected from cement or adhesive (such as glue). The reinforcing layer 3 is used to enhance the connecting effect of the bag units 11 such that the stability of the wall 1 piled by the bag units 11 is improved obviously to adapt for operation in different circumstance.

Figure 4:
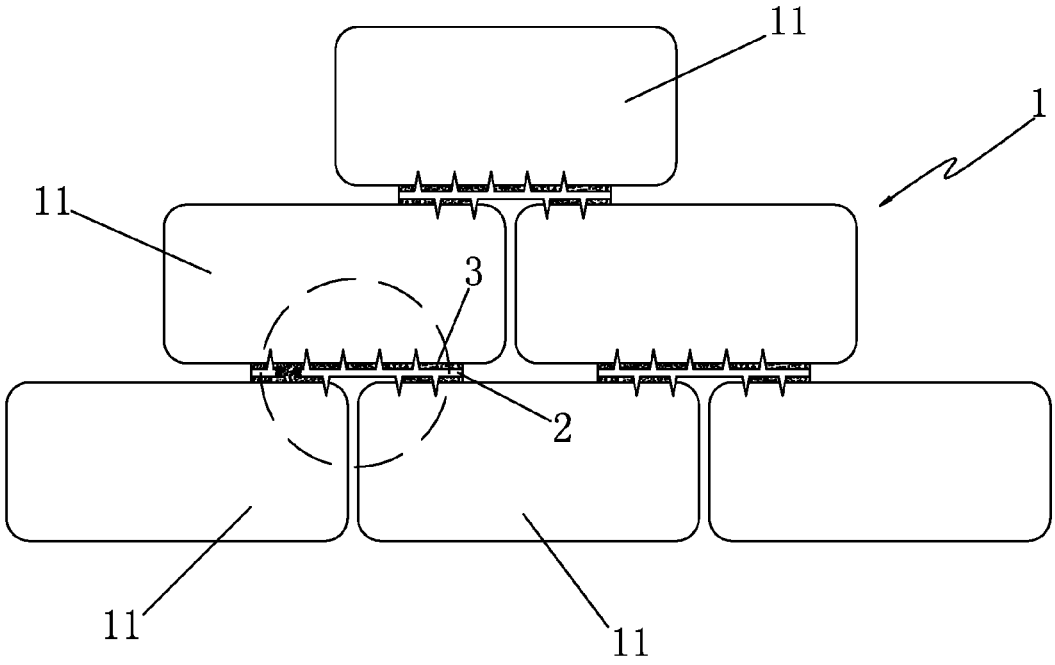
FIG. 4 is a schematic view according to a second preferred embodiment of the present invention.
Figure 5:
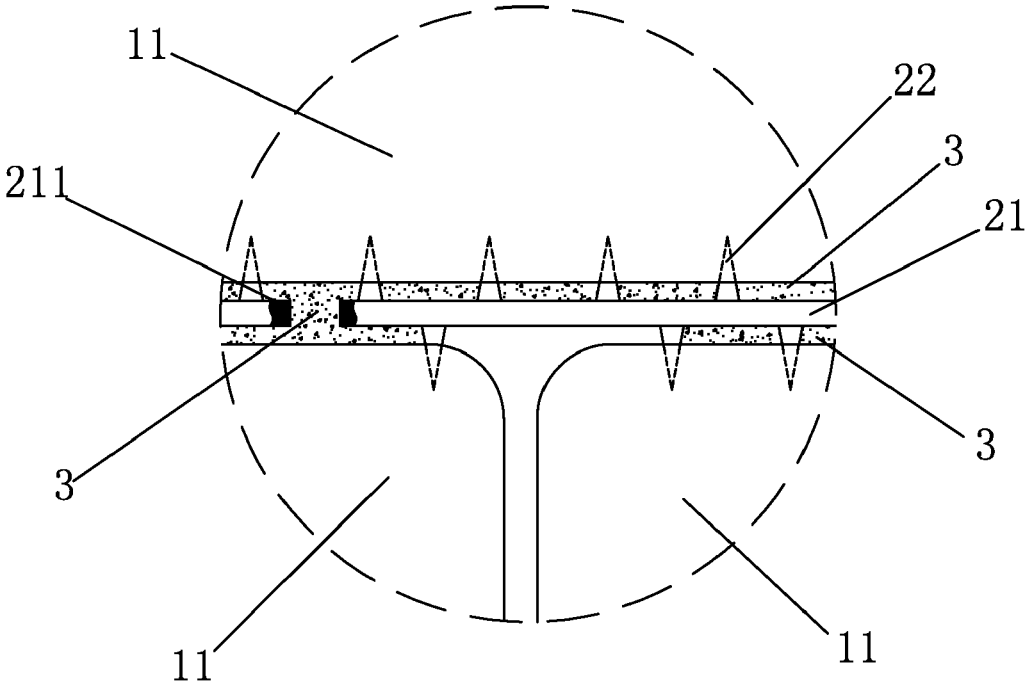
FIG. 5 is a partially enlarged view of FIG. 4.
Figure 6:
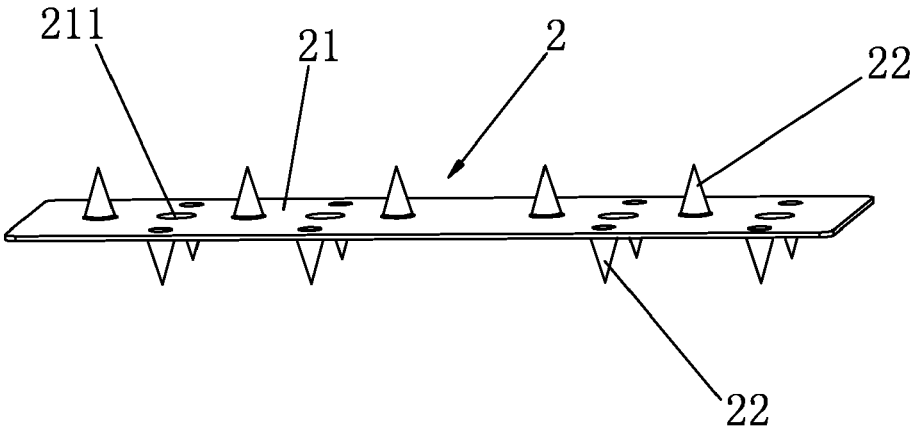
FIG. 6 is a perspective view of an interconnecting unit according to the second preferred embodiment of the present invention.

FIGS. 4 through 6 show a second preferred embodiment of the present invention, which is substantially similar to the first preferred embodiment with the exceptions described hereinafter. The plate 21 of the interconnecting unit 2 has a number of through holes 211. The through holes 211 are adapted for permeation of the material of the reinforcing layer 3, such as cement or adhesive (glues). The reinforcing layer 3 extends through the through holes 211 and is still located between vertically adjacent bag units 11 so that the wall 1 piled by the bag units 11 has enough stability.

Figure 7:
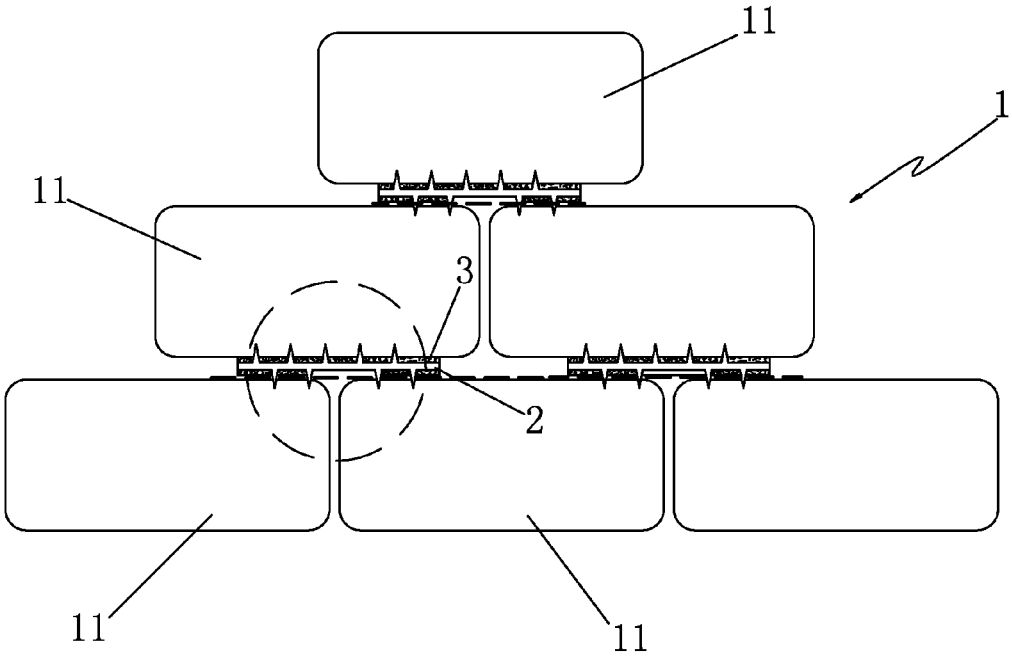
FIG. 7 is a schematic view according to a third preferred embodiment of the present invention.
Figure 8:
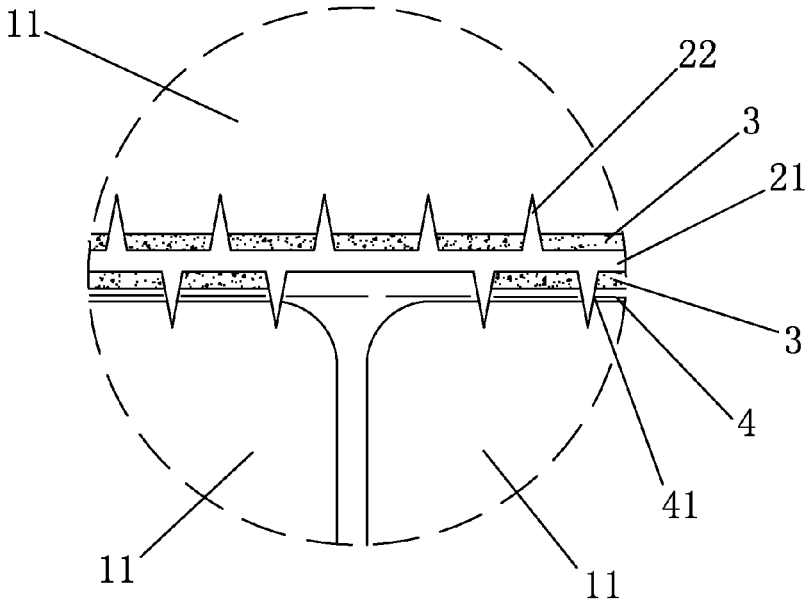
FIG. 8 is a partially enlarged view of FIG. 7.
Figure 9:
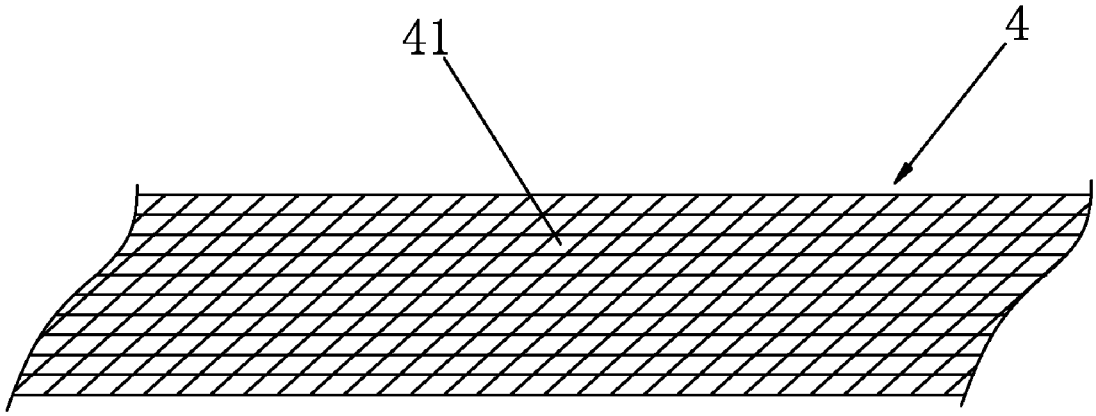
FIG. 9 is a perspective view of a reinforcing net according to the third preferred embodiment of the present invention.

FIGS. 7 through 9 show a third preferred embodiment of the present invention, which is substantially similar to the first and second preferred embodiments with the exceptions described hereinafter. A reinforcing net 4 is provided on every other layer or multiple layers of the bag units 11 to enhance the stability of the wall 1 more securely. The reinforcing net 4 is tightly attached between the plate 21 of the interconnecting unit 2 and the reinforcing layer 3. The reinforcing layer 3 is also selected from cement or glue. The protrusions 22 on the plate 21 penetrate through net holes 41 of the reinforcing net 4.

The feature of the present invention is to use the reinforcing layer located between the plate of the interconnecting unit and the bag unit to enhance the entire stability of the retaining wall structure for operation in different circumstances. In addition, the bag unit is filled with stuffing which is a mixture of plant growing material and absorbent material. The plant growing material is soil or organic soil. The absorbent material is absorbent resin. Plant seeds may be mixed in the stuffing. The plant growing material and absorbent material provide essential nutrients and moisture to the plant seeds, achieving a green effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A retaining wall structure, comprising a number of bag units, interconnecting units disposed between vertically adjacent bag units, each of the interconnecting units comprising a plate; and protrusions protruding from an upper and a lower surface of the plate, and a reinforcing layer containing cement or adhesive materials provided between the plate of an interconnecting unit and bag units, wherein a $1^{st}$ bags-adjoining-reinforcing-layer continuum is formed between said bag units and said reinforcing layer by said cement or said adhesive materials within said reinforcing layer penetrating into said bag units, and a $2^{nd}$ protrusions-adjoining continuum is formed between protrusions of said interconnecting units by said cement or adhesive materials penetrating to said interconnecting units.

2. The retaining wall structure as claimed in claim 1, wherein the plate of each of the interconnecting units is formed with a number of through holes for permeation of the cement or adhesive materials from said reinforcing layer.

3. The retaining wall structure as claimed in claim 1, wherein a reinforcing net is provided on every other layer or multiple layers of the bag units, the reinforcing net being tightly attached between the plate of the interconnecting unit and the reinforcing layer, the protrusions on the plate penetrating through net holes of the reinforcing net.

4. The retaining wall structure as claimed in claim 1 or claim 2, the bag unit is a containing bag.

5. The retaining wall structure as claimed in claim 4, the containing bag is filled with stuffing and plant seeds.

* * * * *

UNITED STATES PATENT AND TRADEMARK OFFICE

CERTIFICATE OF CORRECTION

PATENT NO. : 8,371,772 B2
APPLICATION NO. : 12/306255
DATED : February 12, 2013
INVENTOR(S) : Chang It is certified that error appears in the above-identified patent and that said Letters Patent is hereby corrected as shown below:

On the Title Page, item (30) please delete "2007 2 0052730 U" and replace it with --2007 2 0052730.1--.

Signed and Sealed this
Twenty-fourth Day of September, 2013

Teresa Stanek Rea
*Deputy Director of the United States Patent and Trademark Office*